US009799269B2

(12) United States Patent
Huangfu et al.

(10) Patent No.: US 9,799,269 B2
(45) Date of Patent: Oct. 24, 2017

(54) PIXEL CIRCUIT, DISPLAY PANEL AND DRIVING METHOD THEREOF

(71) Applicant: Boe Technology Group Co., Ltd., Beijing (CN)

(72) Inventors: Lujiang Huangfu, Beijing (CN); Tuo Sun, Beijing (CN); Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 14/785,140

(22) PCT Filed: Feb. 9, 2015

(86) PCT No.: PCT/CN2015/072534
§ 371 (c)(1),
(2) Date: Oct. 16, 2015

(87) PCT Pub. No.: WO2016/074356
PCT Pub. Date: May 19, 2016

(65) Prior Publication Data

US 2016/0372040 A1 Dec. 22, 2016

(30) Foreign Application Priority Data

Nov. 13, 2014 (CN) ..... 2014 1 0640326

(51) Int. Cl.

| | |
|---|---|
| ***G09G 3/30*** | (2006.01) |
| ***G09G 3/3258*** | (2016.01) |
| ***G09G 3/3266*** | (2016.01) |
| ***G09G 3/20*** | (2006.01) |
| *G09G 3/3291* | (2016.01) |

(52) U.S. Cl.
CPC ..... *G09G 3/3258* (2013.01); *G09G 3/2014* (2013.01); *G09G 3/2022* (2013.01);
(Continued)

(58) Field of Classification Search
CPC .. G09G 3/30; G09G 3/36; G09G 5/00; G09G 5/10; G09G 5/02; G06F 3/038; G06K 9/00
See application file for complete search history.

(56) References Cited

U.S. PATENT DOCUMENTS

2009/0213046 A1* 8/2009 Nam ..... G09G 3/3233 345/76
2012/0026147 A1 2/2012 Komiya
(Continued)

FOREIGN PATENT DOCUMENTS

CN 102956197 3/2013
CN 103366678 10/2013
(Continued)

OTHER PUBLICATIONS

Office action from Chinese Application No. 201410640326.0 dated Jan. 27, 2016.
(Continued)

*Primary Examiner* — Pegeman Karimi
(74) *Attorney, Agent, or Firm* — Calfee, Halter & Griswold LLP

(57) ABSTRACT

The present disclosure provides a pixel circuit, a display panel and a driving method thereof. The pixel circuit comprises a charging module, a light-emitting device and a capacitor. The present disclosure achieves a pulse width modulation driving with a pixel data refreshing frequency that is equal to a frame frequency, and addresses the problem of a large operation current and a low service life with the light-emitting device in the pixel. Furthermore, it features in low power consumption, a simple structure and being easy to implement.

15 Claims, 4 Drawing Sheets

(52) U.S. Cl.
CPC ..... *G09G 3/3266* (2013.01); *G09G 3/3291* (2013.01); *G09G 2300/043* (2013.01); *G09G 2300/0809* (2013.01); *G09G 2300/0819* (2013.01); *G09G 2300/0842* (2013.01); *G09G 2300/0861* (2013.01); *G09G 2310/0259* (2013.01); *G09G 2320/043* (2013.01); *G09G 2330/028* (2013.01); *G09G 2330/04* (2013.01)

(56) References Cited

U.S. PATENT DOCUMENTS

| | | | | |
|---|---|---|---|---|
| 2012/0139890 | A1 | 6/2012 | Choi | |
| 2013/0128173 | A1* | 5/2013 | Wu | G09G 5/00 349/43 |
| 2014/0049531 | A1* | 2/2014 | Kwak | G09G 1/005 345/211 |
| 2014/0098082 | A1* | 4/2014 | Kwon | G09G 3/3291 345/212 |
| 2014/0313241 | A1 | 10/2014 | Ono et al. | |
| 2014/0375537 | A1* | 12/2014 | Chung | G09G 3/344 345/107 |

FOREIGN PATENT DOCUMENTS

| | | |
|---|---|---|
| CN | 103474023 | 12/2013 |
| CN | 103839517 | 6/2014 |
| CN | 104299573 | 1/2015 |
| CN | 204117567 | 1/2015 |
| EP | 1846910 | 10/2007 |
| JP | 2013-092681 | 5/2013 |

OTHER PUBLICATIONS

International Search Report and Written Opinion from PCT/CN15/072534 dated Aug. 10, 2015.

* cited by examiner

PIXEL CIRCUIT, DISPLAY PANEL AND DRIVING METHOD THEREOF

RELATED APPLICATIONS

The present application is the U.S. national phase entry of PCT/CN2015/072534, with an international filing date of Feb. 9, 2015, which claims the benefit of Chinese Patent Application No. 201410640326.0, filed Nov. 13, 2014, the entire disclosures of which are incorporated herein by reference.

FIELD OF THE DISCLOSURE

The present disclosure relates to the field of display technology, and more particularly to a pixel circuit, a display panel and a driving method thereof.

BACKGROUND OF THE DISCLOSURE

In existing active matrix organic light-emitting diode (AMOLED) display panels, there exist two types of driving mechanisms: analog driving and pulse width modulation (PWM) driving.

In an AMOLED pixel circuit employing the analog driving, a current flowing through an OLED of the pixel is controlled according to a display grayscale. Since the OLED device operates infrequently at a maximum current, it benefits from a prolonged lifetime. However, for this type of driving, a driving device (e.g. a thin film transistor, TFT) generally has to suffer a large divisional voltage from voltage modulation, which results in ineffective power consumption and hence low efficiency. Additionally, the need for a precise control over the current generally leads to a complicated, associated pixel circuit.

By contrast, in an AMOLED pixel circuit employing the pulse width modulation driving, the TFT operates in a linear region, which results in a small voltage drop and hence low ineffective power consumption, thereby meeting the requirement of the existing display device for low power consumption. However, the pulse width modulation driving technology divides an image frame period into a plurality of sub-frames, and controls a total pulse width of a driving pulse being ON within one image frame period by driving the light-emitting device of the pixel to switch ON/OFF within each sub-frame, so as to achieve a grayscale control (i.e., outputting digits "0" or "1" discretely, which can produce a similar effect to an analog output when a refreshing frequency is sufficiently high). Thus, if the pulse width modulation driving is applied directly to drive the pixel circuit, the frequency of data control signal refreshing and driving actions has to be much greater than the display frame frequency, which is difficult to implement in circuits. Moreover, with the OLED of the pixel operating only in either an ON state with a maximum current or an OFF state with a zero current, the operation current is large during the ON state of the OLED of the pixel, which easily results in a reduced service life of the OLED of the pixel.

Therefore, there is a need for an improved pixel circuit, display panel and driving method thereof.

SUMMARY OF THE DISCLOSURE

It would be advantageous to implement a pixel circuit driven by a pulse width modulation which employs a decreased frequency of pixel data refreshing (which may be the same as the frame frequency, for example). It would also be desirable to provide a display panel which employs such a pixel circuit as well as a driving method thereof.

To better address one or more of these concerns, in a first aspect of the disclosure, pixel circuit is provided comprising a charging module, a light-emitting device and a capacitor. The charging module is connected to a first terminal of the capacitor for charging the capacitor with a data signal voltage under a control of a scan signal, the light-emitting device. A first terminal of the light-emitting device is connected to the first terminal of the capacitor and a second terminal of is connected to a low level voltage line. The device is used for emitting light depending on a current flowing through the light-emitting device from the first terminal thereof. A second terminal of the capacitor is connected to a reference voltage line, and wherein within each frame period the reference voltage line outputs a first voltage when the charging module is charging the capacitor with the data signal voltage, and outputs, upon completion of the charging under the control of the scan signal, a voltage signal which increases gradually from a second voltage until an end of the frame period, the voltage signal increasing up to a third voltage at the end of the frame period. The first voltage is less than the second voltage and the second voltage is less than the third voltage, and the reference voltage line is used for causing the light-emitting device to start emitting light continuously from a moment in time during the gradual increase of the voltage signal to the end of the frame period, the moment in time being related to a magnitude of the data signal voltage.

Optionally, the charging module comprises a first switch element, a first terminal of the first switch element being connected to the data signal voltage, a control terminal of the first switch element being connected to the scan signal, a second terminal of the first switch element being connected to the first terminal of the light-emitting device and the first terminal of the capacitor.

Optionally, the pixel circuit further comprises a reverse current preventing module for disconnecting a connection of the second terminal of the light-emitting device to the low level voltage line when the capacitor is charged with the data signal voltage.

Optionally, the first switch element is a thin film transistor.

Optionally, the reverse current preventing module comprises a second switch element, a first terminal of the second switch element being connected to the second terminal of the light-emitting device, a second terminal of the second switch element being connected to the low level voltage line.

Optionally, the second switch element is a thin film transistor.

Optionally, the first switch element is a p-channel thin film transistor and the second switch element is an n-channel thin film transistor, or the first switch element is an n-channel thin film transistor and the second switch element is a p-channel thin film transistor. A control terminal of the second switch element is connected to the scan signal.

Optionally, both the first switch element and the second switch element are n-channel thin film transistors or p-channel thin film transistors. A control terminal of the second switch element is connected to an inverted signal of the scan signal.

Optionally, the light-emitting device is a light-emitting diode.

In a second aspect of the present disclosure, a display panel is provided comprising an array substrate and/or a color filter substrate, wherein a pixel circuit on the array substrate and/or color filter substrate employs any of the pixel circuits in the above first aspect.

In a third aspect of the present disclosure, a driving method of a display panel is provided, wherein the display panel employs the display panel of claim 10, a frame period for each line of pixels of the display panel comprising, in chronological order, a first moment in time, a second moment in time and a third moment in time, and the third moment in time of each frame period being in coincidence with the first moment in time of a next frame period, the driving method comprising: transitioning, at the first moment in time, the scan signal from a first level to a second level, and outputting by the reference voltage line the first voltage; transitioning, at the second moment in time, the scan signal from the second level to the first level, and outputting by the reference voltage line the second voltage; and transitioning, at the third moment in time, the scan signal from the first level to the second level, and the output of the reference voltage line from the third voltage to the first voltage; wherein the voltage outputted by the reference voltage line increases, between the second moment in time and the third moment in time, gradually from the second voltage and up to the third voltage at the third moment in time, and wherein the first level and the second level are one of a high level and a low level, respectively.

Embodiments of the present disclosure are based on a fundamental principle that by means of the charging and discharging of a capacitor, a light-emitting device of a pixel starts emitting light continuously from a moment in time within a frame period until the end of the frame period, with the location of the moment in time within the frame period being determined by a data signal voltage. In other words, the pixel circuit can determine a length of light-emitting time for the light-emitting device within each frame period according to a magnitude of the data signal voltage, so as to achieve pulse width modulation driving of the luminance, wherein the frequency of data refreshing for the pixel circuit is the same as the frame frequency, with no high frequency of data refreshing needed.

Thus, a large instantaneous current due to a large threshold voltage would not occur to the light-emitting device, which may address the problem of a large operation current and a low service life with the pixel light-emitting device. Moreover, as compared to the analog driving mechanism, the pulse width modulation driving implemented by embodiments of the present disclosure has the advantages that it is higher in efficiency due to less ineffective power consumption, simpler in structure due to elimination of need of modules or circuits for a precise current control, and easier to implement due to less components, no excessive control signal lines and no modifications to the basic structure of the pixel circuit.

It should be appreciated that it is unnecessary for all embodiments of the present disclosure (products or methods) to achieve these above-mentioned advantages all together.

BRIEF DESCRIPTION OF THE DRAWINGS

More details, features and advantages are disclosed in the following description of exemplary embodiments with reference to the accompanying drawings, in which:

FIG. 4(*b*) is a variation curve of a current present on an OLED of the pixel circuit as shown in FIG. 2 in the case of a minimum luminance;

In FIGS. 1 to 8:

Scan line—scan signal line; Data line—data signal voltage line;

$C_{st}$ ref. line—reference voltage line;

M1—first switch element; M2—second switch element; $C_{st}$—capacitor;

OLED—light-emitting device; N1—circuit node at a first terminal of the light-emitting device;

$V_{ss}$—low level voltage; Frame Period—frame period;

$C_{st}$ chr.—phase of data signal voltage writing; $C_{st}$ dschr—phase of capacitor discharging;

$t_{ini}$—starting moment in time of frame period and phase of data signal voltage writing;

$t_0$—ending moment in time of phase of data signal voltage writing and starting moment in time of phase of capacitor discharging;

$t_{fp}$—ending moment in time of phase of capacitor discharging and frame period;

$t_1$—moment in time when light-emitting device starts emitting light;

$V_{ini}$—first voltage; $V_0$—second voltage; $V_t$—third voltage.

DETAILED DESCRIPTION OF THE DISCLOSURE

Embodiments of the present disclosure are described in detail below with reference to the accompanying drawings.

Figure 1:
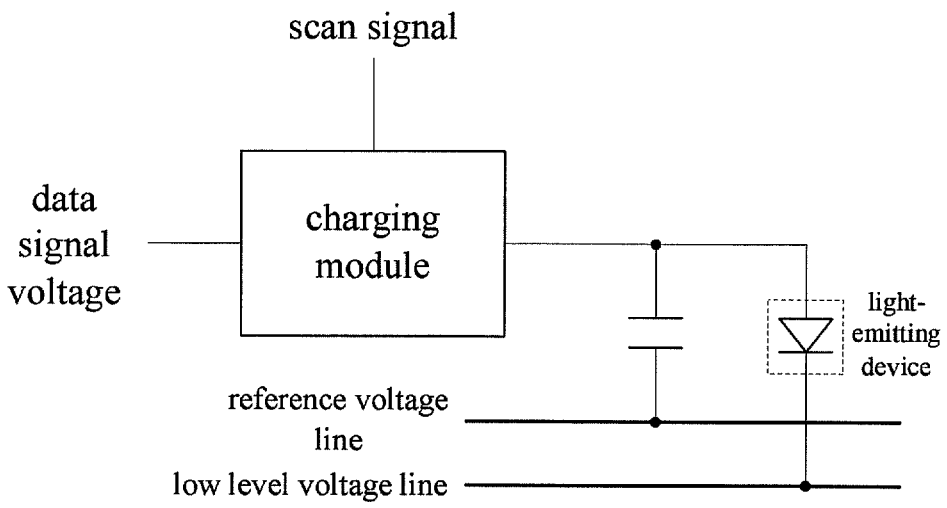
FIG. 1 is a structural block diagram of a pixel circuit according to an embodiment of the present disclosure.

FIG. 1 shows a structural block diagram of a pixel circuit according to an embodiment of the present disclosure. Referring to FIG. 1, the pixel circuit comprises a charging module, a light-emitting device and a capacitor. The charging module is connected to a first terminal of the capacitor for charging the capacitor with a data signal voltage under a control of a scan signal. A first terminal of the light-emitting device is connected to the first terminal of the capacitor, and a second terminal of the light-emitting device is connected to a low level voltage line. The light-emitting device is used for emitting light depending on a current flowing through the light-emitting device from the first terminal thereof. A second terminal of the capacitor is connected to a reference voltage line.

Within each frame period, the reference voltage line outputs a first voltage when the charging module is charging the capacitor with the data signal voltage, and outputs, upon completion of the charging under the control of the scan signal, a voltage signal which increases gradually from a second voltage, wherein the voltage signal increases up to a third voltage at the end of the frame period. The first voltage is less than the second voltage, and the second voltage is less than the third voltage. The reference voltage line is used for causing the light-emitting device to start emitting light continuously from a moment in time during the gradual increase of the voltage signal to the end of the frame period, the moment in time being related to a magnitude of the data signal voltage (discussed below in detail).

In FIG. 1, the light-emitting device is denoted by a sign of a diode, the anode of which corresponds to the first terminal of the light-emitting device, and the cathode of which corresponds to the second terminal of the light-emitting device. The upper terminal of the capacitor in this figure corresponds to the first terminal, and the lower terminal to the second terminal.

Specifically, each frame period for the pixel circuit is divided into a phase of data signal voltage writing and a phase of capacitor discharging.

At the phase of data signal writing, the reference voltage line outputs a first voltage to the second terminal of the capacitor, and the charging module supplies, under the control of the scan signal, a voltage to the first terminal of the capacitor utilizing the data signal voltage, to charge the capacitor to finish the writing process, with the charges accumulated by the capacitor being related to the data signal voltage. The setting of the magnitude of the first voltage requires in the charging process that the difference between the voltage on the first terminal of the light-emitting device and the voltage on the low level voltage line be smaller than a minimum operation voltage the light-emitting device required for a noticeable emission of light (that is, the magnitude of the first voltage is sufficiently small). In this way, no large current passes through the light-emitting device in the charging process, without causing an accidental emission of light of the light-emitting device or a negative effect on the service life thereof.

A completion of the data signal voltage writing is followed by the phase of capacitor discharging. At this point, the charging module under the control of the scan signal no longer supplies a voltage to the first terminal of the capacitor, and the capacitor discharges, with the second terminal thereof being connected to the reference voltage line, to the light-emitting device (as the second terminal of the light-emitting device is connected to the low level voltage, charges accumulated on the polar plate of the capacitor flow spontaneously to this low level position, producing a current flowing through the light-emitting device from the first terminal thereof). Meanwhile, the reference voltage line outputs to the second terminal of the capacitor the voltage signal increasing gradually from the second voltage, i.e. the potential of the first terminal of the light-emitting device is increased gradually. Upon the end of the frame period (the phase of capacitor discharging), the voltage signal outputted by the reference voltage line to the second terminal of the capacitor increases up to the third voltage. Of course, since the light-emitting device generally has a threshold voltage (i.e., the current may pass through it and cause it to emit light only when the voltage across it is greater than the threshold voltage), there may be some instances where the light-emitting device does not start emitting light until the potential of the first terminal thereof increases to a certain value. With the capacitor written by the data signal voltage, an initial value is present on the first terminal of the light-emitting device which is related to the magnitude of the data signal voltage (and which of course is also related to the capacitance of the capacitor). Thus, the time at which the light-emitting device starts emitting light during the increase of the voltage signal on the reference voltage line is related to the magnitude of the data signal voltage. In particular, in the case where other conditions such as the capacitance etc. are fixed, this time is determined by the magnitude of the data signal voltage.

Thereby, the light emission duration (from the moment in time when emission of light starts to the end of the frame period) of the light-emitting device within each frame period can be modulated by the magnitude of the data voltage signal. This is similar to a duty cycle modulation of a square wave signal, that is, pulse width modulation driving of the pixel circuit is achieved.

It can be seen that the present disclosure may achieve a modulation of the light emission duration (duty cycle of a signal) within each frame period at a frequency of pixel data refreshing that is equal to the frame frequency using the data signal voltage. Therefore, a large instantaneous current due to a large threshold voltage would not occur to the light-emitting device, that is, the problem of a large operation current and a low service life with the pixel light-emitting device is addressed.

Figure 2:
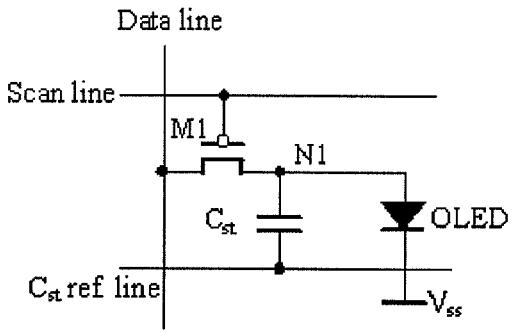
FIG. 2 is an optional, specific circuit schematic of a pixel circuit according to an embodiment of the present disclosure.

To illustrate the technical solution of the embodiment more clearly, FIG. 2 illustrates an optional, specific circuit schematic of a pixel circuit according to an embodiment of the present disclosure.

As shown in FIG. 2, the pixel circuit comprises a charging module, a light-emitting device and a charge storage capacitor $C_{st}$, wherein the charging module comprises a first switch element M1. A first terminal of the first switch element M1 is connected to a data signal voltage line (Data line), a control terminal of the first switch element M1 is connected to a scan signal line (Scan line), and a second terminal of the first switch element M1 is connected to a first terminal of the light-emitting device and a first terminal of the charge storage capacitor $C_{st}$. In other words, under the control of the signal of the control terminal, the charging module can achieve connection or disconnection of the data signal voltage on the data line to the first terminal of the light-emitting device, and thus charging of the capacitor $C_{st}$. Optionally, the light-emitting device is an organic light-emitting diode (OLED).

Figure 3:
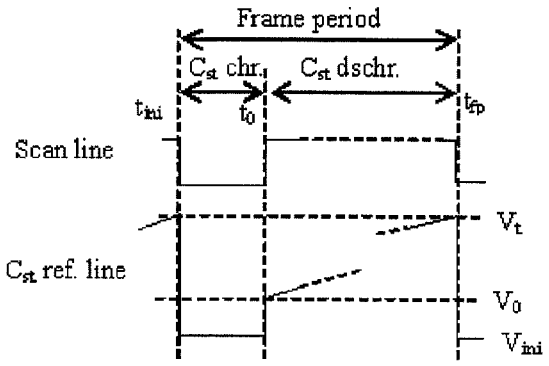
FIG. 3 is an operation timing diagram of the pixel circuit as shown in FIG. 2.

FIG. 3 is an operation timing diagram of the pixel circuit as shown in FIG. 2. The specific process is as follows.

At the moment in time $t_{ini}$, the frame period and the phase of data signal voltage writing start. The potential $C_{st}$ ref. on the reference voltage line of the charge storage capacitor $C_{st}$ that has finished the OLED driving and charging for a previous frame is initialized to a first voltage $V_{ini}$ that is sufficiently low, and the first switch element M1 is switched on by the scan signal line such that $C_{st}$ is charged via M1 by the (luminance or grayscale) data signal voltage on the data signal voltage line (Data line). A sufficiently low $V_{ini}$ requires in the charging process that the difference between the potential $V_{N1}$ at node N1 and the potential $V_{ss}$ of the cathode of the OLED (due to e.g. a parasitic effect) should not be greater than an operation voltage $V_{op}$ required by the OLED for a noticeable, normal emission of light, i.e. $V_{N1}-V_{ss}<V_{op}$. Thus, no large current passes through the OLED of the pixel in the charging process, causing no negative effect on the service life of the OLED.

At the moment in time $t_0$, the phase of data signal voltage writing ends and the phase of capacitor discharging starts. Upon completion of the charging, the reference potential $C_{st}$ ref. of the second terminal of the charge storage capacitor $C_{st}$ is controlled to jump to a second voltage $V_0$, such that under this potential:

for $C_{st}$ that is charged with the maximum luminance data signal voltage, it starts discharging to the OLED of the pixel with a suitable discharge driving current $I_{dscjr}$. Subsequently, the reference potential increases continuously to maintain the suitable discharge driving current from $C_{st}$ to the OLED of the pixel until the end of the frame period (the moment in time $t_{fp}$). Upon the ending of the frame period, the reference potential $C_{st}$ ref. of $C_{st}$ reaches the highest third voltage $V_t$, and the discharging ends.

for $C_{st}$ that is charged with a smaller luminance data signal voltage, during the increase of the reference potential $C_{st}$ ref. of the capacitor $C_{st}$ from the second voltage $V_0$, the OLED of the pixel fails to emit light noticeably due to a low potential at node N1. Not until the potential difference between node N1 and the cathode of the OLED ($V_{N1}-V_{ss}$) becomes greater than $V_{op}$ (at the moment in time $t_1$, which is not indicated in FIG. 3) due to an increase of the potential on the reference voltage line, can the OLED of the pixel start emitting light with a suitable current till the end of the frame period.

Corresponding to data signal voltages for different luminance, the light emission duration of the OLED of the pixel within a frame period is different, and thus the display brightness differs, thereby achieving display of grayscales. The light emission moment in time $t_1$ being at which point between $t_0$ and $t_{fp}$ is related to the quantity of charges that are written to $C_{st}$ by the data signal voltage, and the quantity of charges is, in turn, related to the magnitude of the data signal voltage and the capacitance of the capacitor $C_{st}$.

It can be seen that the pulse width modulation driving implemented by embodiments of the present disclosure, as compared to the analog driving mechanism, is simpler in structure due to elimination of need of modules or circuits for a precise current control, and is higher in efficiency due to less ineffective power consumption. In addition, it is easier to implement due to less components, no excessive control signal lines and no modifications to the basic structure of the pixel circuit.

Figure 4A:
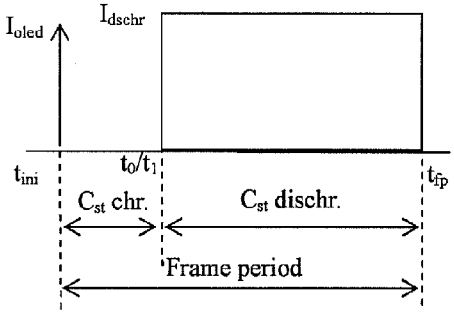
FIG. 4(*a*) is a variation curve of a current present on an OLED of the pixel circuit as shown in FIG. 2 in the case of a maximum luminance.
Figure 4B:
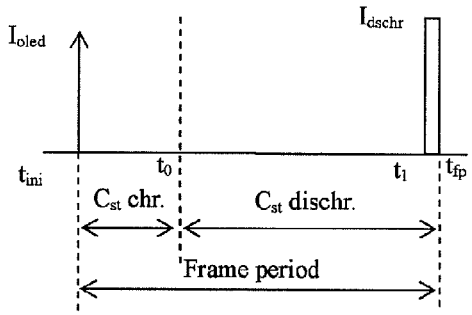

FIGS. 4(*a*) and 4(*b*) are respectively a variation curve of a current present on an OLED of the pixel circuit as shown in FIG. 2 in the case of a maximum/minimum luminance, showing the variation of the current flowing through the OLED after the writing of the data signal voltage corresponding to the maximum luminance and the minimum luminance, respectively.

In FIG. 4(*a*), the charging is completed with the data signal voltage corresponding to the maximum luminance, at which point let the potential $V_{N1}$ at node N1 equals $V_{max}$ ($V_{N1}=V_{max}$). $V_{max}$ satisfies:

$$V_{max}=V_{op}+V_{ss}-(V_0-V_{ini})$$

When $V_{ini}$ jumps to the second voltage $V_0$, the potential $V_{N1}$ at node N1 reaches $V_{op}+V_{ss}$, and the charge storage capacitor $C_{st}$ starts discharging with a current $I_{dschr}$ to allow light emission of the OLED. The magnitude of $I_{dschr}$ is related to the capacity of $C_{st}$ and the variation speed of $V_{ref}$. To maintain a normal light emission luminance, it is further required for $I_{dschr}$ to satisfy the requirement of the I-V characteristic of the OLED of the pixel, i.e. a certain current $I_{oled}$ under an operation voltage $V_{op}$:

$$I_{dschr} = \frac{C_{st}\cdot(V_t - V_0)}{t_{fp} - t_0} = I_{oled}(V_{op})$$

A suitable capacitance of $C_{st}$ and a variation range ($V_t$-$V_0$) of the reference potential of the capacitor $C_{st}$ may be set according to the above equation.

In FIG. 4(*b*), the charging is completed with the data signal voltage corresponding to the minimum luminance, at which point let the potential $V_{N1}$ at node N1 equals $V_{min}$ ($V_{N1}=V_{min}$). $V_{min}$ satisfies:

$$V_{min}=V_{op}+V_{ss}-(V_t-V_{ini})$$

Upon completion of the charging, the potential at node N1 equals $V_{min}$, and within the whole frame period the potential difference between node N1 and the cathode of the OLED would not be greater than the normal operation voltage $V_{op}$ of the OLED of the pixel. With no sufficiently large current flowing through all the time, the OLED of the pixel does not emit light and a black pixel is displayed.

In the case in between those of FIGS. 4(*a*) and 4(*b*) that the potential at node N1 is less than $V_{max}$ and greater than $V_{min}$, the moment when the potential across the OLED of the pixel reaches $V_{op}$ is later than $t_0$ and earlier than $t_{fp}$. With the light emission duration of the OLED of the pixel becoming shorter within a frame period, the visual brightness is less than the maximum luminance, thus achieving display of a grayscale (or only an instantaneous light emission is performed at the end of the frame period, which may be considered as there being no emission of light).

Optionally, the pixel circuit may further comprise a reverse current preventing module for disconnecting a connection of the second terminal of the light-emitting device to the low level voltage line when the capacitor is charged with the data signal voltage. Taking into account that it is possible for the light-emitting device to be damaged due to a large current when being reversely switched on, in order to prevent the light-emitting device from damage, improper light emission or other faults affecting the accuracy of the charging that result from a reverse current of the light-emitting device due to a decreased potential at node N1 in charging the capacitor $C_{st}$, the reverse current preventing module may be provided as needed to disconnect the connection of the second terminal of the light-emitting device to the low level voltage line during the phase of data signal voltage writing.

Figure 5:
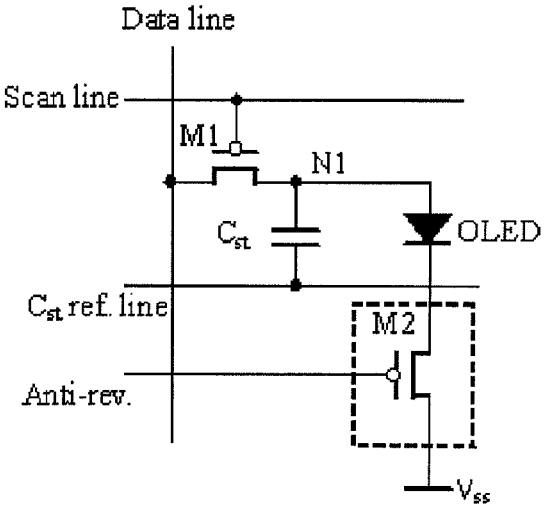
FIG. 5 is a circuit schematic of a pixel circuit comprising a reverse current preventing module according to an embodiment of the present disclosure.

FIG. 5 shows a circuit schematic of a pixel circuit comprising a reverse current preventing module according to an embodiment of the present disclosure. In this figure, the reverse current preventing module is shown as a part denoted by the dashed line box. The reverse current preventing module comprises a second switch element M2. A first terminal of the second switch element M2 is connected to the second terminal of the light-emitting device OLED. A second terminal of the second switch element M2 is connected to the low level voltage line $V_{SS}$. In other words, the second terminal of the light-emitting device OLED and the low level voltage line $V_{SS}$ is separated by the switch element, with which the connection or disconnection therebetween is controlled.

In an example, either of the first switch element M1 and the second switch element M2 is an n-channel thin film transistor or a p-channel thin film transistor. Using a thin film transistor (TFT) to perform the function of the switch element can be compatible with the formation process of existing pixel circuits, and have a variety of advantages originated from the thin film transistor itself. The above drawings are only illustrated taking the p-channel thin film transistor as an example, with the first terminal of the switch element corresponding to a source electrode of the TFT, the control terminal corresponding to a gate electrode of the TFT, and the second terminal corresponding to a drain electrode of the TFT. As the levels for switching on an n-channel thin film transistor and a p-channel thin film transistor are different, equivalent substitution between those two requires interchanging of the levels for their respective gate electrode signal, i.e. adjustment of the polarity of their driving timing signals.

Figure 6:
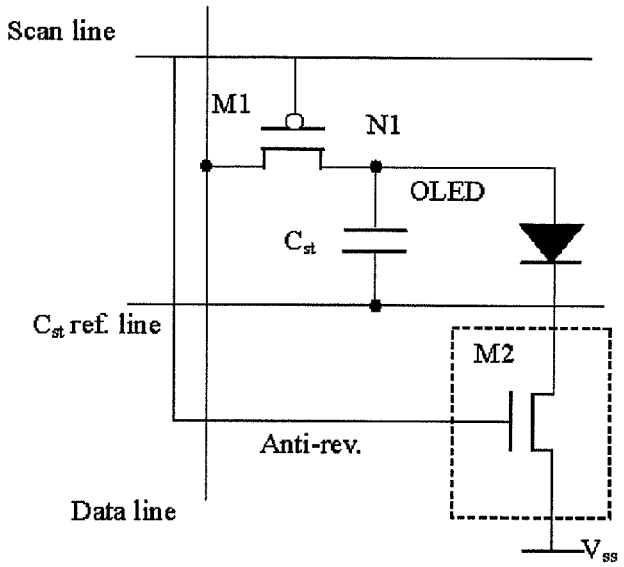
FIG. 6 is a circuit schematic of a pixel circuit comprising another reverse current preventing module according to an embodiment of the present disclosure.

For example, the first switch element M1 is a p-channel thin film transistor and the second switch element M2 is an n-channel thin film transistor, or the first switch element M1 is an n-channel thin film transistor and the second switch element M2 is a p-channel thin film transistor. The above two alternatives are implementations where it is taken into account that the switching states for M1 and M2 are opposite and thus a shared timing driving signal in a CMOS circuit can be employed, which further simplifies the circuits of the implementations. FIG. 6 shows such an example where the control terminals of both the first switch element M1 and the second switch element M2 are connected to the scan signal.

Also, for example, it is possible that both the first switch element M1 and the second switch element M2 are n-channel thin film transistors or p-channel thin film transistors. The control terminal of the second switch element M2 is connected to an inverted signal of the scan signal. In this case, controlling M2 directly with the inverted signal of the scan signal can also simplify the circuit.

Figure 7:
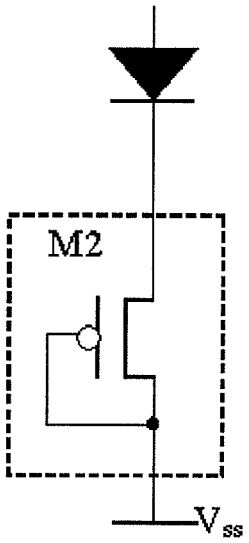
FIG. 7 is a circuit schematic of a pixel circuit comprising yet another reverse current preventing module according to an embodiment of the present disclosure.

FIG. 7 shows a circuit schematic of another pixel circuit according to an embodiment of the present disclosure. For a low temperature poly-silicon (LTPS) technology, an enhanced mode p-channel metal-oxide-semiconductor field effect transistor (MOSFET) can generally be formed as the reverse current preventing module herein with a basis process. This is primarily based on the characteristic that the TFT is in an OFF state when the gate-source voltage is 0 V. In the circuit of FIG. 7, when the second terminal of the OLED is at a low level potential less than $V_{ss}$ at the first moment in time $t_{ini}$, the terminal of M2 that is connected to $V_{ss}$ becomes the source electrode, and at this point the gate-source voltage of M2 equals 0 V, such that the TFT cuts off and functions to protect the OLED by preventing a reverse current. However, when the potential at the second terminal of the OLED increases with the potential of Cst ref. line and becomes significantly greater than $V_{ss}$, the terminal of M2 that is connected to the OLED becomes the source electrode, and at this point the gate-source voltage is less than 0 V, such that M2 enters an ON state to allow the driving current of the OLED to flow through.

According to another aspect of the present disclosure, a display panel_is provided comprising an array substrate and/or a color filter substrate, and the pixel circuit on the array substrate and/or color filter substrate may employ one or more of the pixel circuits as described above. The structures of the array substrate and/or color filter substrate except the described pixel circuit are well-known in the art, and thus need not be discussed here in detail. Additionally, the provided display panel may be applied to a display device, which may be any product or component having a display function, such as an AMOLED panel, a cell phone, a tablet, a television set, a display, a notebook, a digital frame, a navigator and the like.

According to yet another aspect of the present disclosure, a driving method corresponding to the display panel is provided.

Figure 8:
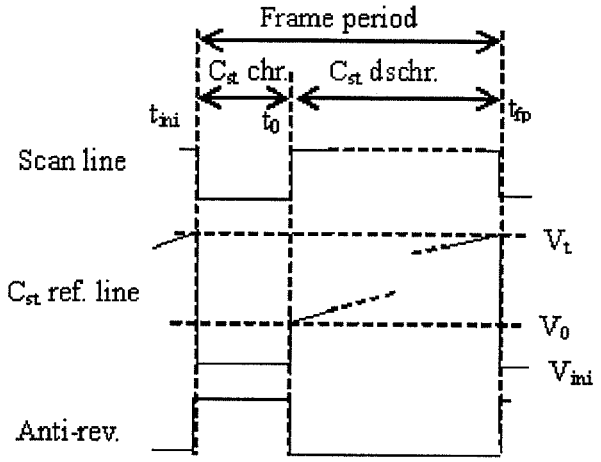
FIG. 8 is a timing diagram corresponding to a driving method of a display panel according to an embodiment of the present disclosure.

FIG. 8 shows a timing diagram corresponding to such a driving method. Referring to FIG. 8, the frame period for each line of pixels of the display panel comprises, in chronological order, a first moment in time $t_{ini}$, a second moment in time $t_0$ and a third moment in time $t_{fp}$, wherein the third moment in time $t_{fp}$ of each frame period being in coincidence with the first moment in time $t_{ini}$ of a next frame. The driving method comprises:

transitioning, at the first moment in time $t_{ini}$, the scan signal (Scan line) from a first level to a second level, and outputting by the reference voltage line (Cst ref. line) the first voltage $V_{ini}$;

transitioning, at the second moment in time $t_0$, the scan signal (Scan line) from the second level to the first level, and outputting by the reference voltage line (Cst ref. line) the second voltage $V_0$; and transitioning, at the third moment in time $t_{fp}$, the scan signal (Scan line) from the first level to the second level, and the output of the reference voltage line (Cst ref. line) from the third voltage $V_t$ to the first voltage $V_{ini}$;

wherein the voltage outputted by the reference voltage line (Cst ref. line) increases, between the second moment in time $t_0$ and the third moment in time $t_{fp}$, gradually from the second voltage $V_0$ and up to the third voltage $V_t$ at the third moment in time $t_{fp}$, and wherein the first level and the second level are one of a high level and a low level, respectively.

As described above, the first moment in time $t_{ini}$ is the moment when the frame period and the phase of data signal voltage writing start, the second moment in time $t_0$ is the moment when the phase of data signal voltage writing ends and the phase of capacitor discharging starts, and the third moment in time is the moment when the phase of capacitor discharging and the frame period end.

It is to be understood that depending on whether n-channel TFTs or p-channel TFTs are used, the first level and the second level are one of the high level and the low level, respectively, which may be determined in accordance with the above embodiments.

The driving method corresponds to the proposed pixel circuit and display panel in the above embodiments of the present disclosure. In a specific implementation of the pixel circuit or display panel, the driving method proposed in the embodiment of the present disclosure may be used.

While several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations are to be performed in the particular order shown or in a sequential order, or that all illustrated operations are to be performed to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Various modifications, adaptations to the foregoing exemplary embodiments of this invention may become apparent to those skilled in the relevant arts in view of the foregoing description, when read in conjunction with the accompanying drawings. Any and all modifications will still fall within the scope of the non-limiting and exemplary embodiments of this invention. Furthermore, other embodiments of the inventions set forth herein will come to mind to one skilled in the art to which these embodiments of the invention pertain having the benefit of the teachings presented in the foregoing descriptions and the associated drawings.

Therefore, it is to be understood that the embodiments of the invention are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A pixel circuit, comprising:

a capacitor having a first terminal and a second terminal, the second terminal being connected to a reference voltage line;

a charging module connected to the first terminal of the capacitor for charging the capacitor with a data signal voltage under a control of a scan signal; and, a light-emitting device having a first terminal and a second terminal for emitting light depending on a current flowing through the light-emitting device from the first terminal thereof, the first terminal being connected to the first terminal of the capacitor, the second terminal being connected to a low level voltage line;

wherein within each frame period the reference voltage line is configured such that the reference voltage line outputs a first voltage when the charging module is charging the capacitor with the data signal voltage, outputs a second voltage upon completion of the charging under the control of the scan signal, and outputs thereafter a voltage signal which increases gradually from the second voltage until the end of the frame period, the voltage signal increasing up to a third voltage at the end of the frame period, the first voltage being less than the second voltage, the second voltage being less than the third voltage; and wherein the voltage signal on the reference voltage line enables the light-emitting device to start emitting light continuously from a moment in time during the gradual increase of the voltage signal to the end of the frame period, the moment in time being related to a magnitude of the data signal voltage.

2. The pixel circuit of claim 1, wherein the charging module comprises a first switch element having a first terminal, a second terminal and a third terminal, the first terminal being supplied with the data signal voltage, the control terminal being supplied with the scan signal, the second terminal being connected to the first terminal of the light-emitting device and the first terminal of the capacitor.

3. The pixel circuit of claim 2, wherein the pixel circuit further comprises a reverse current preventing module for disconnecting a connection of the second terminal of the light-emitting device to the low level voltage line when the capacitor is charged with the data signal voltage.

4. The pixel circuit of claim 3, wherein the first switch element is a thin film transistor.

5. The pixel circuit of claim 3, wherein the reverse current preventing module comprises a second switch element having a first terminal, a second terminal and a third terminal, the first terminal being connected to the second terminal of the light-emitting device, the second terminal of the reverse current preventing module being connected to the low level voltage line.

6. The pixel circuit of claim 5, wherein the second switch element is a thin film transistor.

7. The pixel circuit of claim 5, wherein the first switch element is a p-channel thin film transistor and the second switch element is an n-channel thin film transistor, or the first switch element is an n-channel thin film transistor and the second switch element is a p-channel thin film transistor, and wherein the control terminal of the second switch element is supplied with the scan signal.

8. The pixel circuit of claim 5, wherein both the first switch element and the second switch element are n-channel thin film transistors or p-channel thin film transistors, and wherein the control terminal of the second switch element is supplied with an inverted signal of the scan signal.

9. The pixel circuit of claim 2, wherein the first switch element is a thin film transistor.

10. The pixel circuit of claim 1, wherein the light-emitting device is a light-emitting diode.

11. A display panel comprising: an array substrate wherein the array substrate comprises the pixel circuit of claim 1.

12. A display panel comprising: a color filter substrate wherein the color filter substrate comprises the pixel circuit of claim 1.

13. A method of driving a display panel, wherein the display panel comprises an array substrate having a pixel circuit, wherein a frame period for each line of pixels of the display panel comprises, in chronological order, a first moment in time, a second moment in time and a third moment in time, the third moment in time of each frame period being in coincidence with the first moment in time of a next frame, wherein the pixel circuit comprises a capacitor having a first terminal and a second terminal, the second terminal being connected to a reference voltage line;

a charging module connected to the first terminal of the capacitor for charging the capacitor with a data signal voltage under a control of a scan signal; and, a light-emitting device having a first terminal and a second terminal for emitting light depending on a current flowing through the light-emitting device from the first terminal thereof, the first terminal being connected to the first terminal of the capacitor, the second terminal being connected to a low level voltage line;

wherein within each frame period the reference voltage line is configured to output a first voltage when the charging module is charging the capacitor with the data signal voltage, and to output, upon completion of the charging under the control of the scan signal, a voltage signal which increases gradually from a second voltage until the end of the frame period, the voltage signal increasing up to a third voltage at the end of the frame period, the first voltage being less than the second voltage, the second voltage being less than the third voltage; and wherein the light-emitting device is configured to start emitting light continuously from a moment in time during the gradual increase of the voltage signal to the end of the frame period, the moment in time being related to a magnitude of the data signal voltage, the method comprising:

transitioning, at the first moment in time, the scan signal from a first level to a second level, and outputting by the reference voltage line the first voltage;

transitioning, at the second moment in time, the scan signal from the second level to the first level, and outputting by the reference voltage line the second voltage; and transitioning, at the third moment in time, the scan signal from the first level to the second level, and the output of the reference voltage line from the third voltage to the first voltage;

wherein the voltage outputted by the reference voltage line increases, in between the second moment in time and the third moment in time, gradually from the second voltage and up to the third voltage at the third moment in time, and wherein the first level is one of a high level and a low level and the second level is the other of the high level and the low level.

14. The method of claim 13, wherein the first moment in time is the moment when the frame period and a phase of data signal voltage writing start, the second moment in time is the moment when the phase of data signal voltage writing ends and a phase of capacitor discharging starts, and the third moment in time is the moment when the phase of capacitor discharging and the frame period end.

15. A method of driving a display panel, wherein the display panel comprises a color filter substrate having a pixel circuit, wherein a frame period for each line of pixels of the display panel comprises, in chronological order, a first moment in time, a second moment in time and a third moment in time, the third moment in time of each frame period being in coincidence with the first moment in time of a next frame, wherein the pixel circuit comprises a capacitor having a first terminal and a second terminal, the second terminal being connected to a reference voltage line;

a charging module connected to the first terminal of the capacitor for charging the capacitor with a data signal voltage under a control of a scan signal; and, a light-emitting device having a first terminal and a second terminal for emitting light depending on a current flowing through the light-emitting device from the first terminal thereof, the first terminal being connected to the first terminal of the capacitor, the second terminal being connected to a low level voltage line;

wherein within each frame period the reference voltage line is configured to output a first voltage when the charging module is charging the capacitor with the data signal voltage, and to output, upon completion of the charging under the control of the scan signal, a voltage signal which increases gradually from a second voltage until the end of the frame period, the voltage signal increasing up to a third voltage at the end of the frame period, the first voltage being less than the second voltage, the second voltage being less than the third voltage; and wherein the light-emitting device is configured to start emitting light continuously from a moment in time during the gradual increase of the voltage signal to the end of the frame period, the moment in time being related to a magnitude of the data signal voltage, the method comprising:

transitioning, at the first moment in time, the scan signal from a first level to a second level, and outputting by the reference voltage line the first voltage;

transitioning, at the second moment in time, the scan signal from the second level to the first level, and outputting by the reference voltage line the second voltage; and transitioning, at the third moment in time, the scan signal from the first level to the second level, and the output of the reference voltage line from the third voltage to the first voltage;

wherein the voltage outputted by the reference voltage line increases, in between the second moment in time and the third moment in time, gradually from the second voltage and up to the third voltage at the third moment in time, and wherein the first level is one of a high level and a low level and the second level is the other of the high level and the low level.

* * * * *